US005361948A

United States Patent [19]

Batts

[11] Patent Number: 5,361,948

[45] Date of Patent: Nov. 8, 1994

[54] INSIDE WAISTBAND GARMENT HANGER

[75] Inventor: John H. Batts, E. Grand Rapids, Mich.

[73] Assignee: Batts, Inc., Zeeland, Mich.

[21] Appl. No.: 133,755

[22] Filed: Oct. 7, 1993

Related U.S. Application Data

[63] Continuation of Ser. No. 955,363, Oct. 1, 1992, abandoned, which is a continuation-in-part of Ser. No. 827,051, Jan. 28, 1992, abandoned.

[51] Int. Cl.[5] ..... A47G 25/48

[52] U.S. Cl. ..... 223/96; 223/91

[58] Field of Search ..... 223/85, 95, 96, 91; 24/531, 536, 537, 545, 336; D6/326

[56] References Cited

U.S. PATENT DOCUMENTS

| | | | |
|---|---|---|---|
| 2,408,145 | 9/1946 | Johnson | 223/96 |
| 2,421,051 | 5/1947 | Brinkman . | |
| 2,555,672 | 6/1951 | Baugh | 223/96 |
| 2,616,596 | 11/1952 | Nicholas | 223/96 |
| 2,723,063 | 11/1955 | Carr | 223/91 |
| 2,804,246 | 8/1957 | Brooke . | |
| 3,048,312 | 8/1962 | Birnbaum . | |
| 3,508,664 | 4/1970 | Lessard . | |
| 3,626,553 | 12/1971 | Darney et al. . | |
| 3,767,092 | 10/1973 | Garrison | 223/96 |
| 3,790,043 | 2/1974 | Hager | 223/61 |
| 4,034,903 | 7/1977 | Batts | 223/96 |
| 4,194,274 | 3/1980 | Garrison | 223/96 |
| 4,729,498 | 3/1988 | Blanchard . | |
| 4,744,496 | 5/1988 | Blanchard et al. . | |
| 4,793,531 | 12/1988 | Blanchard et al. . | |
| 4,826,056 | 5/1989 | Duester et al. | 223/96 |
| 4,902,078 | 2/1990 | Judd . | |
| 4,984,721 | 1/1991 | Eiley et al. | 223/96 |
| 5,020,705 | 6/1991 | Garrison . | |
| 5,022,571 | 6/1991 | Blanchard . | |

*Primary Examiner*—Clifford D. Crowder
*Assistant Examiner*—Bibhu Mohanty
*Attorney, Agent, or Firm*—Baker & McKenzie

[57] ABSTRACT

A garment hanger includes an elongated, generally planar body having opposite ends and front and rear surfaces. A clamp is joined adjacent each end of the body with the body defining a wing which extends beyond the clamp. Each clamp includes first and second clamp members hingedly joined to the body adjacent an upper edge thereof. Each clamp member defines a clamping surface which is moveable in an opposed, generally abutting relationship with the clamp members overlying the front and rear surfaces of the body. A support hook is joined to the body intermediate the ends thereof. The garment hanger body is insertable inside the waistband of a pair of slacks, a skirt or the like. The clamp members are moved to a closed position engaging front and back surfaces of the garment. In use, only the front and back clamp members and the support hook are visible, and the hanger does not detract from the visual presentation of the garment.

9 Claims, 2 Drawing Sheets

INSIDE WAISTBAND GARMENT HANGER

This application is a continuation of co-pending application Ser. No. 07/955,363, filed on Oct. 1, 1992, which is a continuation-in-part of application Ser. No. 07/827,051 filed on Jan. 28, 1992, now abandoned.

BACKGROUND OF THE INVENTION

The present invention relates to hangers and, more particularly, to garment hangers for pants, skirts and the like.

Garments, such as pants, slacks or skirts, are generally shipped to retail outlets on hangers. Typically, the hanger engages the garment at the waistband and a plurality of garments are displayed on a rack to the customer. The garment hanger must engage the garment sufficiently so that it will not drop or fall from the hanger during shipment. It is also desirable that the hanger not detract from the visual presentation of the garment at the retail level.

A garment hanger which has achieved wide acceptance in the transport and display of garments at the retail level is disclosed in U.S. Pat. No. 3,767,092 entitled GARMENT CLAMPING HANGER WITH SLIDEABLE LOCKING CLIP, which issued on Oct. 23, 1973 to Garrison et al. As disclosed therein, the garment hanger includes an elongated main body having a generally I-beam shape in cross section and integral clamps at the ends thereof. Each clamp includes a rear clamp member in effect defined by and integral the hanger body. A front clamp member is hinged to the rear clamp member and body along an upper edge thereof. The clamp members are biased together and locked by a generally U-shape spring clip. When used, the garment covers the front face of the hanger body when it is positioned in the clamps. When viewed from the front, the front clamp members, a minor portion of the body and a support hook are viewed. When viewed from the rear of the garment, the elongated garment body and rear clamp members can be seen. The clamp-type garment hanger, including the spring clips, engages the garment with sufficient strength so that the garment may be shipped on the hanger. The profile of the garment hanger is such that detraction from the visual presentation of the garment is minimized. Examples of other hangers of the same general type may be found in U.S. Pat. No. 4,194,274 entitled GARMENT GRIP CONSTRUCTION HANGERS, which issued on Mar. 25, 1980 to Garrison and U.S. Pat. No. 5,020,705 entitled ARTICLE GRIPPING MEANS AND METHOD OF MAKING SAME, which issued on Jun. 4, 1991 to Garrison.

The body of the prior clamp-type hanger must be relatively rigid and constructed to withstand the side bending loads imposed thereon by the garment. It is important that the garments be properly positioned on the hangers and on the display rack so that only front clamp members are viewed. In addition, problems have been encountered using such hangers with garments having thick waistbands or with garments that are shipped with a belt threaded through garment belt loops. The thickness of the waistband area and/or the presence of the belt presents problems with rehanging the garments after they have been removed from the hangers by the customer. The customer may experience difficulty in applying the hanger due to the thickness of the waistband or interference with the belt. The retailer must spend time, therefore, rehanging the garments to improve the appearance of the display.

A need exists for a garment hanger which further minimizes the detraction from the visual presentation of the garment at the retail level, which permits the garment to be shipped thereon to the retailer and which overcomes the aforementioned difficulties encountered with thick waistbands and/or garments shipped with a belt.

SUMMARY OF THE INVENTION

In accordance with the present invention, the aforementioned needs are fulfilled and problems are overcome. Essentially, a garment hanger is provided including a body having front and rear surfaces. A first clamp member is joined to the body and moveable from an open position to a closed position overlying the front surface of the body. A second clamp member is joined to the body and is moveable from an open position to a closed position overlying the rear surface of the body. Each of the clamp members defines a clamping surface adapted to engage a garment when the members are in their closed positions. The garment hanger body is positionable inside the waistband of the garment. Provision is made for locking or holding the clamp members in engagement with the garment.

In narrower aspects of the invention, the body extends outwardly beyond the clamps. The extension acts as a guide-to aid in positioning the hanger on a garment.

When in use, basically, only the first and second clamp members are visible. The body of the hanger is substantially completely inside the waist area of the garment. The hanger readily accommodates garments having thick waistbands and garments shipped with belts. Difficulties with use of the hanger due to interference with the belts are essentially eliminated. The hanger body is positioned on the centerline of the garment. Side bending loads are minimized or no longer applied to the hanger body. The material requirements for the hanger body may be reduced from that heretofore experienced.

DETAILED DESCRIPTION OF THE PREFERRED EMBODIMENT

Figure 1:
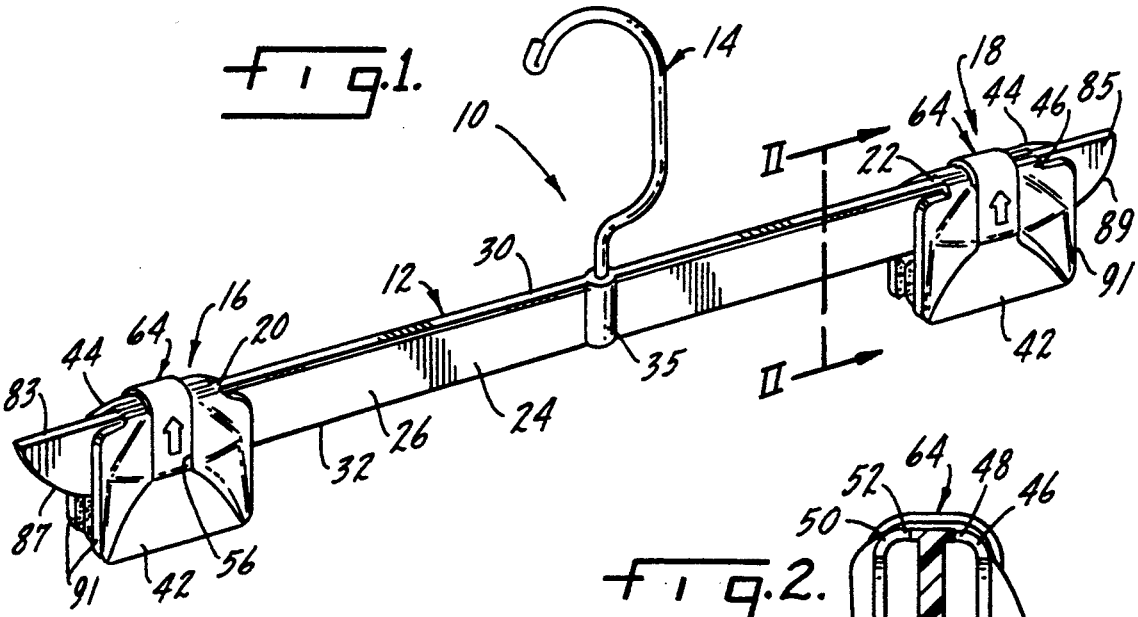
FIG. 1 is a front, perspective view of a garment hanger in accordance with the present invention.

A preferred embodiment of a garment hanger in accordance with the present invention is illustrated in FIG. 1 and generally designated by the numeral 10. Hanger 10 includes a body 12, a support hook 14 and clamp assemblies 16, 18. Assemblies 16, 18 are positioned at the ends 20, 22 of body 12.

Figure 2:
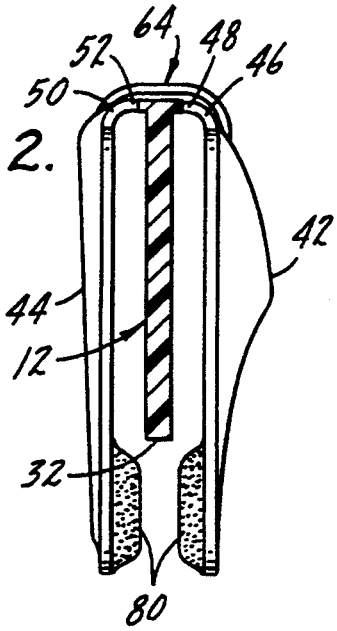
FIG. 2 is a cross-sectional view taken generally along line II—II of FIG. 1.
Figure 3:
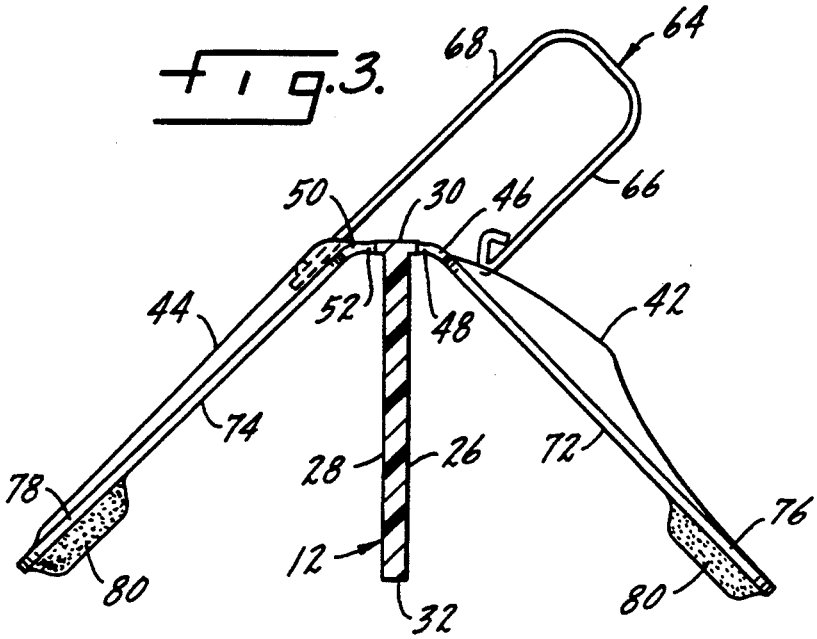
FIG. 3 is a cross-sectional view taken generally along line II—II of FIG. 1 with the clamp members of the hanger moved to an open position.

As seen in FIGS. 1, 2 and 3, body 12 is an elongated, generally planar member including a main portion 24 which defines a front surface 26 and a rear surface 28. Body 12 includes an elongated, upper, horizontal and linear reinforcing flange 30 formed integral therewith. Flange 30 defines a horizontal upper edge of the body. Body 12 has a generally T-shape in vertical cross section. Ends 20, 22 curve upwardly from the lower edge 32 to the upper edge of the hanger body defined by horizontal flange 30. Body 12 may be formed with a central hook receiving portion 35 intermediate the ends thereof. Support hook 14 may be a wire hook joined to the hanger at portion 35 subsequent to the molding operation. In the alternative, as is known in the art, a fixed support hook may be molded integral with body 12 during the manufacturing process.

Clamp assemblies 16, 18 are identical in construction. As shown, each clamp assembly includes a first or front clamp member 42 and a second or rear clamp member 44. Clamp member 42 includes an upper edge 46. Edge 46 is moveably joined to flange 30 by an integral, living hinge 48. Rear clamp member 44 also includes an upper edge 50 which is joined to the rear or opposite side of flange 30 by a living hinge 52. The clamp members are joined to the body with upper edges 46, 50 in juxtaposed relationship at the upper surface of flange 30. The clamp members fully cover the hanger body when in the closed position. Body 12 extends downwardly at and from edges 46, 50. It is presently preferred that hanger body 12 and clamp members 42, 44 be molded as an integral, one-piece unit from a suitable plastic material such as polypropylene.

Figure 5:
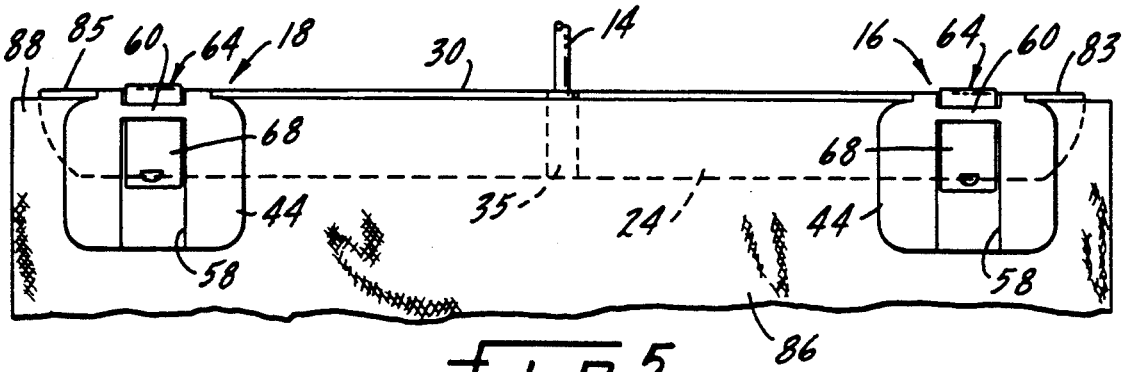
FIG. 5 is a rear, elevational view of the hanger supporting a garment.

Each front clamp member 42 defines a recess 56. As seen in FIG. 5, each rear clamp member 44 defines a recess 58. In addition, member 44 defines a retaining strap 60. A generally U-shaped, spring steel biasing or locking clip 64 engages the clamp member. Clip 64 includes a leg 66 disposed within recess 56 and a leg 68 disposed and retained within recess 58. Clip 64 resiliently biases inner surfaces 72, 74 of members 42, 44, respectively, towards each other to exert a clamping force on a garment or other article positioned between the clamp members.

A lower portion of inner surfaces 72, 74 defines clamping surfaces 76, 78. Surfaces 76, 78 are each provided with a garment gripping pad 80. Pads 80 positively grip the garment positioned therebetween. As shown in FIG. 2, when clip 64 is pushed downwardly, pads 80 are moved into an opposed, facing relationship. Clamp members 42, 44 overlie the front and rear surfaces 26, 28 of hanger body 12. Lower edge 32 of hanger body 12 is positioned adjacent yet above pads 80 and clamping surfaces 76, 78.

Body 12 includes integral extensions or wings 83, 85. The extensions terminate at inwardly curved edges 87, 89. Edges 87, 89 extend downwardly to lower edge 32 of body 12 and join the lower edge adjacent outer lateral edges 91 of the clamp members. As discussed below, the extensions function as guides to assist in positioning the hanger body in and on a garment.

It is presently preferred that pads 80 be formed with clamp members 42, 44 as disclosed in commonly owned U.S. Pat. No. 5,020,705 entitled ARTICLE GRIPPING MEANS AND METHOD OF MAKING SAME, which issued on Jun. 4, 1991 to Garrison which, to the extent necessary, is hereby incorporated by reference. In the alternative, clamping surfaces 76, 78 could be formed with teeth or projections as disclosed in U.S. Pat. No. 3,767,092, which issued Oct. 23, 1973 to Garrison et al. or U.S. Pat. No. 4,194,274 entitled GARMENT GRIP CONSTRUCTION FOR HANGERS, which issued on Mar. 25, 1980 to Garrison. To the extent necessary, these patents are also hereby incorporated by reference.

In the preferred form, pads 80 are molded with the clamp members during the manufacturing process so as to become an integral part of the hanger. A suitable material for molding the pads includes certain thermoplastic rubbers manufactured by Shell Oil Company and sold under the brand name KRATON. The manufacturing process and the materials are described in the aforementioned U.S. Pat. No. 5,020,705.

The clamps may have the general configuration illustrated. Other ornamental configurations for these components may, of course, be used. For example, the configuration of the clamp members as shown in commonly owned U.S. Pat. No. Des. 316,334 entitled CLAMP FOR A GARMENT CLAMPING HANGER, which issued on Apr. 23, 1991 to Duester, may be employed.

Figure 4:
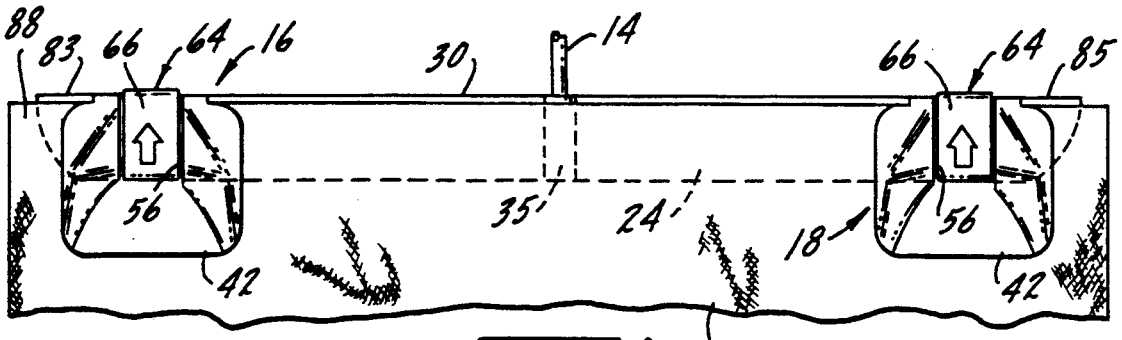
FIG. 4 is a front, elevational view of the hanger in accordance with the present invention shown supporting a garment.
Figure 6:
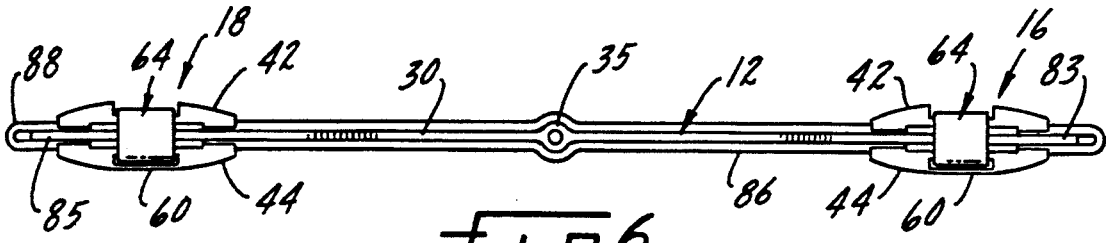
FIG. 6 is a top, plan view of the hanger supporting a garment.

The use of the garment hanger in accordance with the present invention is illustrated in FIGS. 4, 5 and 6. As shown therein, a garment 86 includes a waistband area 88. Hanger 10 is positioned so that body 12 is disposed inside of garment 86 at the waistband. When inserting the hanger body, body extensions 83, 85 extend towards the outer portions of waistband 88 and serve to guide the body into position at which the body is centered in the garment. Clips 64 are pushed downwardly to move clamp members 42, 44 from their open positions as shown, for example, in FIG. 3 to their closed positions as shown in FIGS. 4–6. Members 42, 44 overlie front and rear surfaces of hanger body 12. Clamping surfaces 76, 78 and pads 80 clampingly engage outer or front and rear surfaces of garment 86 to secure the garment to the hanger. As shown, for example, in FIG. 6, hanger body 12 lies on the centerline of the garment. This positioning of the hanger eliminates or minimizes side bending loads on the hanger body. As a result, the hanger body may be manufactured with reduced material requirements and with less rigidity than that necessary to manufacture hanger bodies of prior clamping hangers.

The hanger body is disposed substantially completely within the waistband area of the garment. Essentially, only the clamp members 42, 44, sliding clips 64 and support hook 14 are visible. Distraction with the visual appearance of the garment when displayed is minimized. Since the hanger body is positioned within the waistband and due to the configuration of the clamp members, problems heretofore experienced with thick waistbands and garments with belts are also eliminated. The user can easily clamp members 42, 44 about the garment. The garment hanger is also readily adapted to suspending a pair of slacks with the cuffs or legs folded up and positioned at the back of the waistband. When so used, the hanger body is placed against the back of the waistband, the cuffs are positioned against the hanger body and the clamp members are moved to their closed or operating position engaging the outer surface of the cuffs and an outer surface of the waistband area.

The hanger in accordance with the present invention presents an aesthetically pleasing display for a wide variety of garments including pants, skirts and slacks. A minimum hanger profile is presented. The hanger is readily adapted to fixed and wire swivel hooks. Aesthetically pleasing clamp configurations are readily incorporated. Known molding techniques may be used to manufacture the hanger efficiently and relatively inexpensively.

In view of the above description, those of ordinary skill in the art may envision various modifications which would not depart from the inventive concepts disclosed herein. For example, as discussed above, the configuration of the clamp members may be varied. A lock means other than the slide clip 64 might also be used. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows:

1. A garment hanger comprising:

an elongated generally planar body having a horizontal upper edge, ends, a front surface and a rear surface;

a support hook having a stem extending from the horizontal upper edge of said body;

a first clamp member integral with and hingedly joined to said body at a hinge line substantially at the horizontal upper edge of said body at one end thereof and moveable from an open position to a closed position overlying the front surface of the body; and a second clamp member integral with and hingedly joined to said body at a hinge line substantially at the horizontal upper edge of said body at said one end with said hinge lines being in juxtaposed relationship and moveable from an open position to a closed position overlying said rear surface of said body, said clamp members each defining a clamping surface adapted to engage a garment when said members are in the closed position;

said one end of the body terminating beyond the first and second clamp members to define a first outer guide;

a third and a fourth clamp members integral with and hingedly joined to said body adjacent the other end of said body at said horizontal upper edge, said third and fourth clamp member being moveable from an open position to a closed position overlying said surfaces of said body, said third and fourth clamp members each defining opposed clamping surfaces;

said other end of the body terminating beyond the third and fourth clamp members to define a second outer guide;

said body and said clamp member dimensioned so that the body is disposable substantially completely within a waistband area of a garment with only the clamp members and support hook visible whereby the garment can be presented to a purchaser without substantial detraction by the hanger from the visual presentation of the garment.

2. The garment hanger of claim 1, wherein said clamp members and said body are dimensioned so that said clamping surfaces can be moved into opposed relationship with said body having a lower edge above said clamping surfaces.

3. A garment hanger comprising:

an elongated generally planar body having a horizontal upper edge, a first end and a second end disposed opposite of the first end, a front surface and a rear surface;

a first and a second clamp member integral with and hingedly joined to the body adjacent the first end of the body at the horizontal upper edge, the first and second clamp members being moveable from an open position to a closed position overlying the front and rear surfaces of the body, the first and second clamp members each defining opposed clamping surfaces;

the first end of the body extending beyond the first and second clamp members to define a first outer guide;

a third and a fourth clamp members integral with and hingedly joined to the body adjacent the second end of the body at the horizontal upper edge, the third and fourth clamp members being moveable from an open position to a closed position overlying the surfaces of the body, the third and fourth clamp members each defining opposed clamping surfaces;

the second end of the body terminating beyond the third and fourth clamp members to define a second outer guide.

4. The garment hanger of claim 3, wherein the clamp members and the body are dimensioned so that the clamping surfaces can be moved into opposed relationship with the body having a lower edge above the clamping surfaces.

5. A garment hanger for clamping a waistband of a garment, the hanger comprising:

an elongated body terminating in a first end and a second end, the elongated body including an upper edge and front and rear surfaces;

a first and second pair of opposing clamp members;

the first and second pair of claim members integrally and hingedly connected to opposing sides of the upper edge of the body, the first and second pair of clamp members being moveable from an open position to a closed position overlying the front and rear surfaces of the body;

the first end of the body extending beyond the first pair of opposing clamp members to form a first garment position guide;

the second end of the body extending beyond the second pair of opposing clamp members to form a second garment position guide.

6. The garment hanger of claim 5, wherein the body includes a lower edge, the lower edge of the body being disposed within the first and second pair of clamp members when the first and second clamp members are in closed positions.

7. The garment hanger of claim 6, wherein the first and second pair of clamping members include means for holding the clamping members in the closed position.

8. The garment hanger of claim 7, wherein each clamp member defines an inner clamping surface and a lower inside surface thereof, the lower edge of the body being disposed above the inner clamping surfaces of the clamp members when the first and second clamp members are in closed positions.

9. The garment hanger of claim 8, wherein the inner clamping surfaces each accommodate a garment engaging pad made of resilient thermoplastic material.

* * * * *